US005970156A

United States Patent [19]

Hummelgaard et al.

[11] Patent Number: 5,970,156

[45] Date of Patent: Oct. 19, 1999

[54] METHOD AND APPARATUS FOR REDUCING PERIODIC INTERFERENCE IN AUDIO SIGNALS

[75] Inventors: Poul Hummelgaard, Copenhagen; Spyros A. Ramskov, Lyndby, both of Denmark

[73] Assignee: Telefonaktiebolaget LM Ericsson, Stockholm, Sweden

[21] Appl. No.: 08/800,400

[22] Filed: Feb. 14, 1997

[51] Int. Cl.[6] ..... H04B 15/00

[52] U.S. Cl. ..... 381/94.2

[58] Field of Search ..... 381/71.6, 71.8, 381/71.11, 71.14, 94.2, 94.7, 94.1, 66; 708/322; 704/226

[56] References Cited

U.S. PATENT DOCUMENTS

| | | | |
|---|---|---|---|
| 4,480,335 | 10/1984 | Kishi . | |
| 4,965,854 | 10/1990 | Glazebrook . | |
| 5,170,489 | 12/1992 | Glazebrook . | |
| 5,267,305 | 11/1993 | Prohs et al. | 379/212 |
| 5,455,819 | 10/1995 | Sugiyama | 379/3 |
| 5,608,653 | 3/1997 | Palmer et al. . | |
| 5,619,183 | 4/1997 | Ziegra et al. . | |
| 5,764,757 | 6/1998 | Christinger . | |

FOREIGN PATENT DOCUMENTS

| | | |
|---|---|---|
| 0 340 978 | 11/1989 | European Pat. Off. . |
| 0 590 350 | 4/1994 | European Pat. Off. . |
| 26 18 532 | 11/1977 | Germany . |

OTHER PUBLICATIONS

Wi Drow and Stearns, Adaptive Signal Processing, 1985, pp. 16–18 & 349–350.

*Primary Examiner*—Vivian Chang
*Attorney, Agent, or Firm*—Nixon & Vanderhye P.C.

[57] ABSTRACT

The present invention protects a human operator listening to electronically-generated audible signals from potentially adverse effects of periodic interference contained in the audible signals. The periodic interference is modeled and subtracted from the received audio signal. As a result, the actual periodic interference, being reduced or removed, does not adversely affect the hearing of the operator listening to the received audible signals. Moreover, the human operator still readily discerns the voice received along with the periodic interference despite the fact that the interference has been removed. Thus, while the voice suffers little or no attenuation, the periodic interference is selectively and substantially attenuated.

35 Claims, 5 Drawing Sheets

METHOD AND APPARATUS FOR REDUCING PERIODIC INTERFERENCE IN AUDIO SIGNALS

FIELD OF THE INVENTION

The present invention relates to signal processing, and in particular, to a method and apparatus for reducing periodic interference in audio signals. One example application of the present invention is to telephone handsets and headsets.

BACKGROUND AND SUMMARY OF THE INVENTION

As telecommunication networks have evolved, different types of signals are now communicated over telephone lines in addition to voice signals such as DTMF tones, facsimile signals, etc. Although DTMF tones are traditionally generated to initiate a call, they may also be generated during a call, e.g., when a telephone subscriber is entering a bank account number, credit card number, etc. One problem resulting from these different types of machine-generated signals communicated over the telephone network is the difficulty in setting an amplitude/volume level in a telephone receiver that is appropriate for all types of signals. In particular, a signal level optimal for hearing incoming voice signals is typically too high of a signal level for machine-generated tones and other non-voice signals. This particular problem is especially troublesome for telephone operators who employ a headset rather than a handset to place and receive telephone calls. If such an operator receives a DTMF tone or other machine-generated tone at the volume level set for listening to voice, it is often not possible for the operator to remove the headset in time to avoid "shocking,", or even worse, damaging the operator's ears.

Machine-generated noise like DTMF and fax tones occur unexpectedly and for short time durations making them difficult to anticipate and ameliorate. Because such tones can be generated over a relatively wide frequency band that overlaps the voice bandwidth, it is expensive and therefore not practical to employ fixed filters at particular frequencies to attenuate them. Signal "jamming" of voice communications using periodic interference also presents a problem of changing frequencies. Because such changing periodic interference may be used to "sweep" the voice spectrum, even well-designed filters tailored for a particular and narrow frequency band would be completely ineffective.

Simply lowering the volume level output to a headset is not a particularly good option because the signal level of received speech would likely be too low for a listener to easily discern voice information communicated over the telephone line. Although it might be possible to implement a squelch or noise blanking circuit to squelch/blank all received signals when a tone is detected, such an approach has a major disadvantage. Namely, voice signals or other desired information received at the same time as the tone or other interference would be squelched or blanked out as well.

It is an object of the present invention to provide an audio signal processing method and apparatus that solves these problems by reducing periodic interference in received voice signals so the periodic interference does not (1) surprise the human operator listening to the audio signal using a communications device like a telephone headset or handset or (2) adversely affect the hearing of the human operator.

It is a further object of the present invention to provide such a method and apparatus that specifically reduces periodic interference like facsimile tones, DTMF tones, and other oscillatory signals that may be received during a telephone call being listened to by a human operator.

It is a further object of the present invention to adaptively track and reduce periodic interference that changes in frequency.

It is another object of the present invention to preserve the voice received along with the periodic interference after that periodic interference is reduced or otherwise eliminated.

These and many other objects are achieved by the inventive method which protects an operator listening to electronically-generated audible signals. Received audio signals including both voice signals and interfering signals in the same frequency band are processed before being sent to a speaker. Periodic interference is modeled, and based on that modeled periodic interference, the actual periodic interference in the received audio signals is reduced or removed. As a result, the periodic interference does not adversely affect the hearing of the operator listening to the received audible signals. Moreover, the operator still readily discerns the voice received along with the periodic interference despite the fact that the interference has been reduced or removed. Thus while the voice suffers little or no attenuation, the periodic interference is selectively and substantially attenuated.

The present invention has particularly advantageous application in a call handling system such as a centralized call handling center where plural telephone operators are connected to a telecommunications switch via a network or other routing mechanism. Each operator is provided with a computer station, such as a personal computer, along with a communications device having a microphone and a speaker. Audio signals are received from the telecommunications switch for delivery to the communications device including both voice and is periodic interference. The volume or decibel level of the periodic interference may exceed a threshold that is uncomfortable or otherwise dangerous to the operator listening to the received signal.

The received signals are processed to make sure that this periodic interference does not exceed that threshold. The audio signal is sampled at a predetermined sampling rate to generate a signal sequence. Based on a previous sequence of samples, a contribution of a current signal sample corresponding to the periodic interference is predicted. That predicted contribution is removed from the current sample to ensure that the decibel level of the periodic interference present in the current signal sample ultimately used in reconstructing the analog signal delivered to the speaker of the communications device is less than the threshold.

Periodic interference is predicted by taking advantage of its periodicity. The interference is predicted directly from the audio signal without the need for an external reference signal (corresponding to the interference) generated from a source other than the audio signal itself. More specifically, the signal sequence is processed by delaying the signal sequence for a predetermined delay. The delayed signal sequence is filtered, and the filter output consisting of an estimated current value of the periodic interference sequence is subtracted from an undelayed current value of the signal sequence to generate a difference signal. The periodic interference has therefore been substantially attenuated or effectively removed or cancelled. In this way, the current value of the periodic interference sequence is predicted using previous values of the received signal sequence. The predicted signal is removed from the actual audio signal to generate an audio signal that for the most part is includes only the desired voice signal.

In such a call handling system, each telephone operator's work station (or communication device) contains an audio processor. The audio processor includes an analog-to-digital converter for converting received audio signals into digitized audio samples. An adaptive filter receives the digitized audio samples and substantially reduces the amplitude of tones or other periodic interference in a current audio sample while at the same time substantially preserving both the content and the signal level of the voice information in the current audio sample. Thereafter, a digital-to-analog convertor converts the signal output from the adaptive filter into an analog audio signal. An amplifier may be provided to amplify the audio signal and then forward the amplified signal to drive the speaker in the operator's communication device.

The audio processor implements a signal processing procedure that predicts the tones or other periodic interference occurring in the current audio sample based on previously processed audio samples and subtracts the predicted tones or other periodic interference from the current sample. The predictor is adaptive and therefore tracks changes in frequency in the tones or other interference.

The present invention further provides a digital filter which provides particularly advantageous application in a call handling system such as that described above but also has wide signal processing application. The digital filter includes a delay stage that receives a digitized sequence of samples corresponding to an audio signal that includes both voice and interference. Series-connected filter taps are connected to the delayed signal sequence. Parallel multipliers each multiply a signal from a corresponding one of the filter taps and a corresponding adaptive filter coefficient. A summer sums outputs from the multipliers to generate a signal that predicts the periodic interference in the current signal sample. The predicted periodic interference is then subtracted from the current sample to obtain a difference signal corresponding substantially or entirely to just the voice content of the input audio signal. That difference signal is also employed by an adaptive controller that recursively modifies the filter coefficients in order to minimize the error between the predicted periodic interference and the actual periodic interference. The optimal parameters of the digital filter for application in a call handling system such as that described above are disclosed.

BRIEF DESCRIPTION OF THE DRAWINGS

These as well as other objects and advantages of the present invention will be better appreciated by reading the following detailed description of the presently preferred example embodiment of the present invention taken in conjunction with the accompanying drawings in which.

FIG. I is a function block diagram of a call center in which the present invention may be applied.

DETAILED DESCRIPTION OF INVENTION

In the following description, for purposes of explanation and not limitation, specific details are set forth, such as particular embodiments, circuit configurations, techniques, etc. in order to provide a thorough understanding of the present invention. However, it will be apparent to one skilled in the art that the present invention may be practiced in other embodiments that depart from these specific details. In other instances, detailed descriptions of well known methods, devices, and circuits are omitted so as not to obscure the description of the present invention with unnecessary detail.

Figure 1:
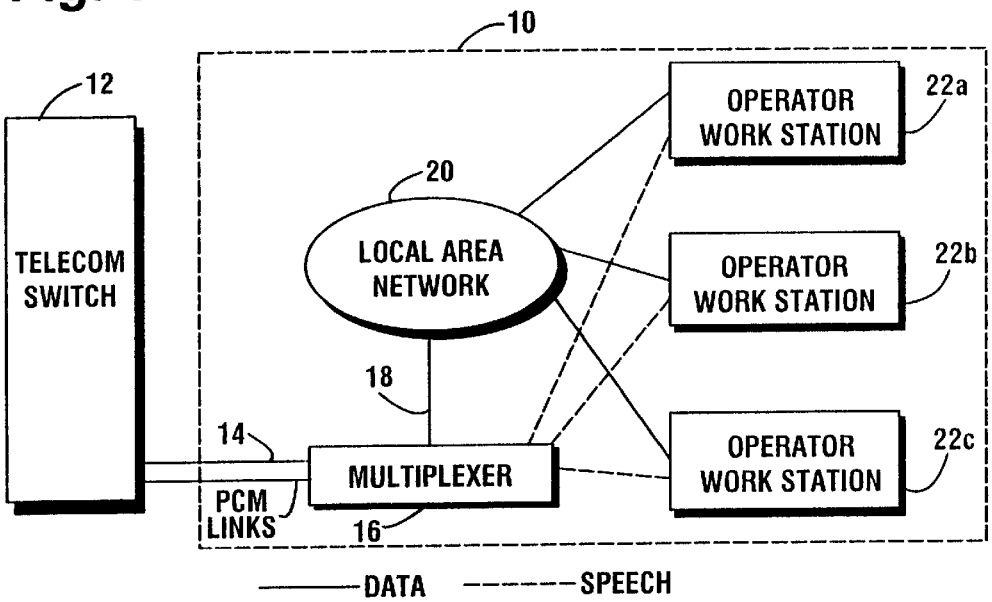

FIG. 1 illustrates a call handling system 10 connected to a telecommunications switch 12 via pulse code modulation (PCM) links 14. In particular, the PCM links 14 are connected to a multiplexer 16 which routes certain telephone calls to selected ones of the operator workstations 22*a*, 22*b*, and 22*c*. The speech paths are indicated in FIG. 1 as dashed lines, and data paths are indicated as solid lines. Each operator workstation 22 is connected via a data path to a local area network 20 which is connected by a data link to the multiplexer 18.

Figure 2:
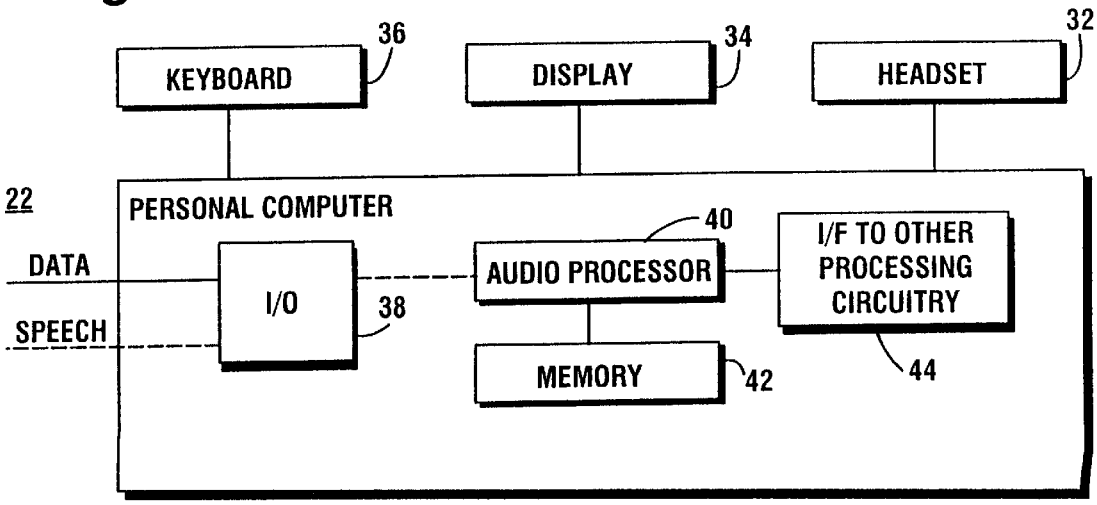
FIG. 2 is a function block diagram of an operator workstation.

FIG. 2 shows in further detail an operator workstation 22 implemented for example as a personal computer 30. The personal computer includes a conventional headset 32 having both a microphone and one or more earphones to be worn by the human operator at the operator workstation 32, a display 34, and a keyboard 36. In addition to the conventional personal computer processing circuitry and memory (not shown), the personal computer 30 includes an input/output block 38 which receives data and speech. The speech is routed by I/O 38 to an audio processor 40 which includes memory 42. Audio processor 40 is also connected to an interface 44 to other PC circuitry. In the preferred implementation, the audio processor 40 and its associated circuitry are implemented as a single, modular PC card in the personal computer 30.

While the present invention is described in the example context of the call handling center 10, and more particularly in the context of an operator workstation 22 used in such a call handling center, the present invention is not limited to this particular example. Indeed, the present invention may be employed in any signal processing application to reduce or otherwise substantially eliminate interfering signals while at the same time preserve signals to be further processed, e.g., listened to by an operator. Similarly, while the present invention finds particularly advantageous application to telephone headsets, it may also be applied to any communications device including, for example, telephones that employ conventional handsets, radio telephones, other audio systems such as FM/AM stereos, etc. Nor does the present invention need to be implemented in a personal computer. Indeed, the present invention may be implemented in circuitry provided within a wireline telephone, a radio telephone, a stereo receiver, etc.

Figure 3:
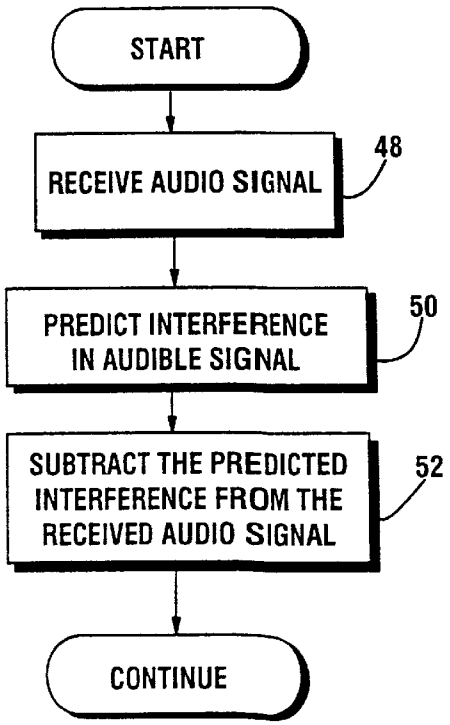
FIG. 3 is a flowchart diagram illustrating procedures followed in implementing the method in accordance with the present invention.

FIG. 3 outlines the general procedures for implementing the methodology employed by the present invention to reduce audible interference in audio signals. The audio signal is received (block 48) and processed to predict the periodic interference (if any) contained in the audible signal (block 50). The predicted interference is subtracted from the received audio signal (block 52). The resulting signal is used for example in driving one or more speakers in a telephone headset, handset, radio, etc. By subtracting the predicted periodic interference from the audio signal, the present invention substantially reduces or effectively removes the periodic interference from the desired voice signals.

Figure 4:
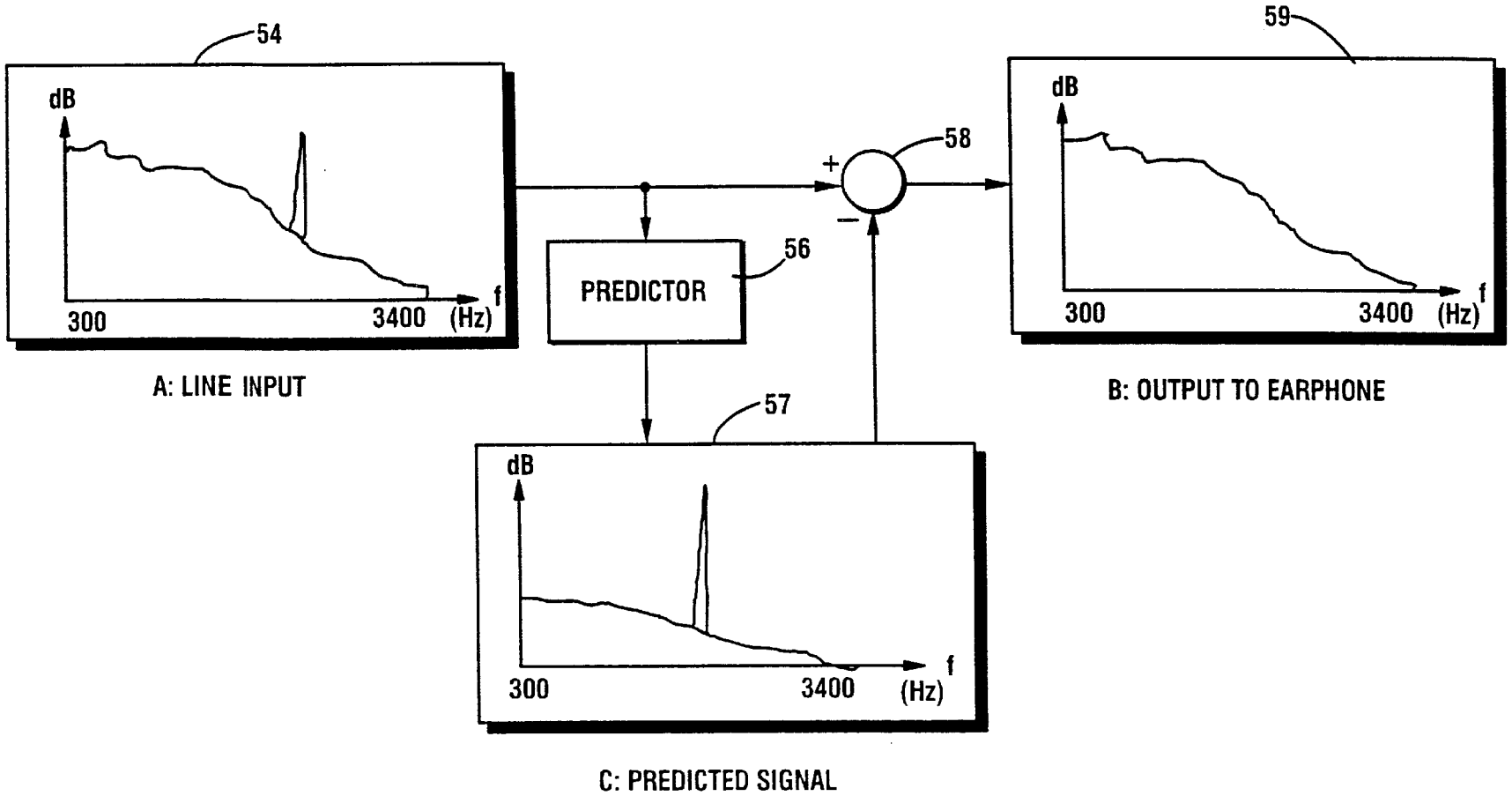
FIG. 4 is an illustrative diagram illustrating conceptually the present invention.

FIG. 4 illustrates graphically an implementation of the method of FIG. 3. The graph enclosed in block 54 shows a frequency spectrum of an example received audio signal referred to as line input A. The frequency characteristic of the line input A in this example corresponds with the bandwidth allocated for voice signals communicated over the conventional wireline telephone network, i.e., from 300 Hz to 3400 Hz. In this example, a relatively narrow spike in the voice spectrum is centered around a single frequency and corresponds for example to a particular tone contained in the voice spectrum. Note that the signal level (measured in dBs) of that tone spike is quite high relative to the signal level of the voice/speech at that same frequency.

The line input A is received by a predictor 56 which generates a predicted interference signal C having a spectrum such as that shown in the graph enclosed in block 57. The predicted signal includes a periodic interference spike generally corresponding in frequency spectrum, shape, and amplitude to the actual periodic interference spike shown in the graph corresponding to line input A. However, the predicted signal has a considerably reduced voice spectrum. As a result, when the predicted signal C is subtracted from the line input A in combiner 58, the resulting output waveform B shown in function block 59 transmitted to the headset earphone shows the spike interference completely removed. While the spike interference is substantially removed, the voice spectrum is substantially unchanged. Of course, the spike interference may not be entirely removed. But even in those circumstance, the present invention still significantly and selectively attenuates that tone spike interference so that even if residual periodic interference is detected by a human operator in the output signal B to the earphone worn by a human operator, the operator will not be startled. Nor will the residual periodic interference harm the human operator's hearing.

The subtraction of the spike interference does not remove or otherwise interfere with the operator's ability to receive and discern voice information at that same frequency at which the tone occurred. The voice signal in the output B to the earphone is substantially the same as the voice signal present in line input A. Any attenuation of the voice signal is minor and does not affect the operator's ability to readily understand the voice content of the received audio signal.

Figure 5:
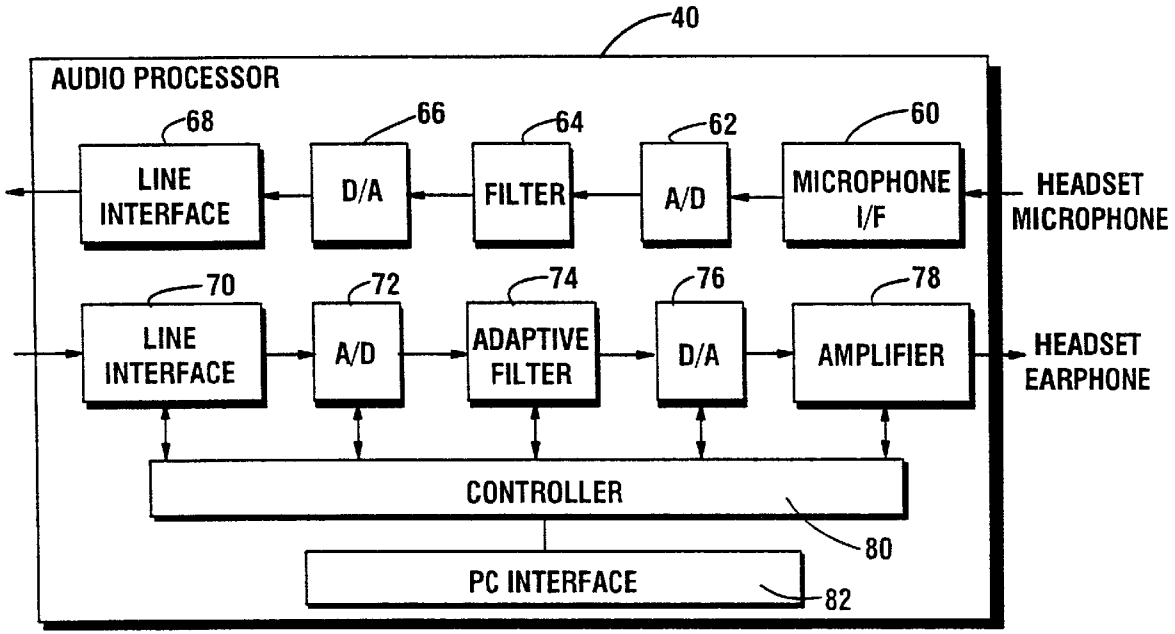
FIG. 5 is a function block diagram of an audio processor which may be used to implement the present invention.

Reference is made to FIG. 5 which shows an audio processor 40 which may be implemented using a suitably programmed digital computer, digital signal processor (DSP), or as an application specific integrated circuit (ASIC). To facilitate illustration and understanding of the preferred implementation of the present invention, however, the audio processor is illustrated using a variety of function blocks.

The signals from the operator's headset microphone are routed to a microphone interface 60. The audio signals detected by the microphone are digitized in the converter 62, filtered in digital filter 64, and converted back to analog format before being output via line interface 68. Those skilled in the art will appreciate that the analog-to-digital converter 62, filter 64, and digital-to-analog converter 66 while desirable, are nevertheless optional, and in any event are not the focus of this invention. In the reverse path, line interface 70 receives audio signals from a telephone that may include voice and other information in the audible frequency range. Of course, those skilled in the art will recognize that the present invention is not limited to the particular bandwidth 300–3400 Hz for voice employed in a traditional telephone network. Moreover, while the present invention finds particularly advantageous application to audible signals, the present invention may also be employed to process signals outside the audible frequency range in order to remove periodic interference present in that same frequency range.

The audio signal of line interface 70 is sampled in analog-to-digital converter 72 at an appropriate sampling rate to generate a sequence of audio data samples r(n). The conventional sampling rate for digitizing speech is 8 kHz where one signal sample is generated every 125 microseconds. The sampled sequence is filtered in adaptive filter 74 in accordance with procedures described in more detail below. The adaptive filter output is converted by digital-to-analog convertor 76 into an analog signal and amplified in amplifier 78 before being passed onto the operator's headset earphone(s). A controller 80 is shown generally to indicate that the various functions indicated in blocks 60–78 are centrally coordinated. The controller 80 is also connected to a PC interface 82 which receives, for example, power from the personal computer, and may also be used to exchange data, e.g., volume increases or decreases.

Figure 6:
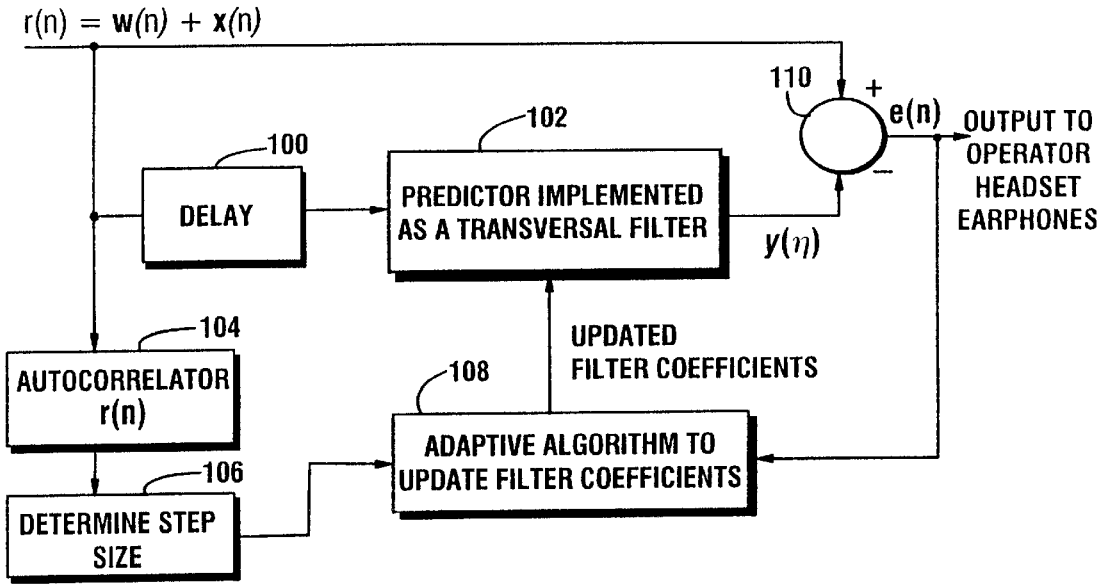
FIG. 6 is a function block diagram of an adaptive filter used to implement the present invention.

The adaptive filter 74 in audio processor 40 is now described in further detail in conjunction with the block diagram of FIG. 6. As opposed to one (or more) fixed or static filter(s) which would have to be designed based on prior knowledge of both the voice signal and the interfering signal, the present invention employs a single adaptive filter which automatically adjusts its filter parameters to predict and remove the periodic interference present in the signal currently being processed. As a result, the adaptive filter design requires little or no prior knowledge of the voice signal or of the periodic interference. The adaptive filter 74 in the preferred example embodiment of the present invention takes advantage of the periodic nature of troublesome interference commonly received by human operators participating in telephone calls. A fax tone for example is a sinusoidal signal having a particular frequency. Dual Tone Multiple Frequency (DTMF) tones include, as the name implies, two (dual) sinusoidal signals at two different frequencies. Using the periodic characteristic of tones and other machine-generated signals, the present invention predicts the interference quickly and with a reasonable degree of accuracy.

The received signal r(n) includes a broadband voice signal w(n) along with a narrowband periodic interference x(n), i.e., $r(n)=w(n)+x(n)$, where n represents the current sample. To predict the narrowband periodic interference x(n) in the current audio sample r(n), the present invention employs a delay 100 to delay the received signal sequence by one or more sample periods. The delayed signal sequence output by the delay 100 is processed by predictor 102 to generate a predicted signal y(n) corresponding to the narrowband periodic interference x(n) of the received signal sample r(n).

In the preferred example embodiment of the present invention, the predictor 102 is implemented as a digital transversal filter sometimes referred to as a finite impulse response (FIR) filter. In general, the predictor 102 quickly predicts the current interference from the previously received group of signal samples to generate an estimate of the periodic interference present in the currently received sample sequence r(n). Conversely, since the broadband noise w(n) is typically not periodic, the voice components of the received signal r(n) are not predicted, and therefore, are substantially preserved and output to the operator's communication device. The output e(n) is generated by a combiner 110 which subtracts from the input signal r(n) the predicted signal y(n) represented mathematically as:

$$e(n)=r(n)-y(n)$$

which by substitution may be written as:

$$e(n)=w(n)+x(n)-y(n).$$

Since y(n) is a predicted estimate of x(n), the above equation can be reduced to e(n) substantially equals w(n).

For the transversal filter to predict or otherwise model periodic interference present in the received signal, the transversal filter coefficients, (which are the model of the predicted interference), must be initialized and updated. Adaptation of the filter coefficients is performed recursively using any one of a number of adaptive algorithms. In a preferred example embodiment, a least mean squares (LMS) algorithm based on the well-known stochastic gradient principle is employed. The adaptive algorithm 108 receives as an input the output signal e(n) which represents an error signal that is to be minimized. The adaptive filter 108 also receives a step size input from block 106. The step size determines whether or not the adaptive algorithm will converge. If it will, the step size affects how quickly the adaptive algorithm converges to the minimum error value.

In the presently preferred example embodiment, the step size is determined as a function of the number of taps in the transversal filter and the strength of the current input audio signal. Accordingly, the input audio signal is routed to an autocorrelator 104 which determines an estimate of the strength of the input signal. Of course, those skilled in the art will appreciate that other techniques could be employed besides autocorrelation to determine an estimate of the signal strength of the input signal. The step size determining block 106 then determines the step size in accordance with the following equation:

$$\text{step size}=k/(t*s),$$

where k is a constant, t corresponds to the number of taps in the transversal filter, and s corresponds to the strength of the current input signal. In one example application, the number of filter taps was selected to be 16 and a k of 0.0078 was empirically determined to give an optimum step size for the 16-tap filter for converging the adaptive algorithm to its minimum error value. Each recursive iteration of the adaptive algorithm for updating the filter coefficients occurs once per sample. The number of iterations needed for the algorithm to converge to its minimum error value determines how quickly and accurately the transversal filter predicts the actual periodic interference in the currently received signal.

Figure 7:
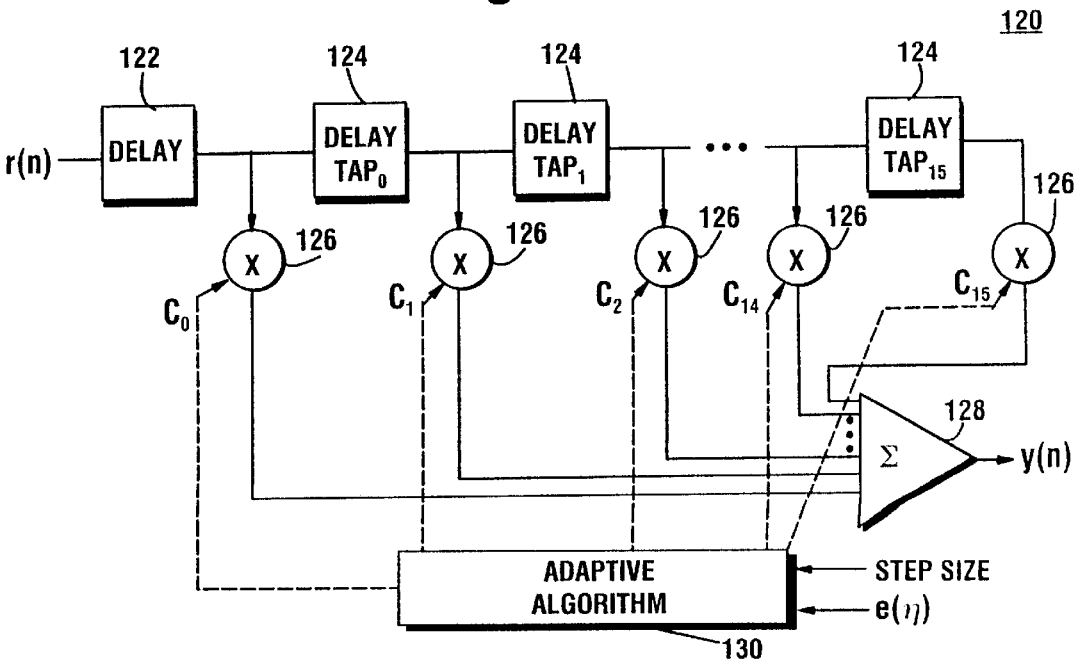
FIG. 7 is a diagram of an example transversal filter that may be used in implementing the present invention.

FIG. 7 is a more detailed drawing of the 16-tap transversal filter 120 referred to above that is one example implementation of the present invention. The transversal filter 120 receives the audio sample sequence r(n) at delay stage 122. After the delay, the input sequence is then passed through 16 filter delay taps (0–15) indicated at reference numeral 124. Each filter tap carries an output to corresponding multiplier 126. If one calls the sample instance "n," then at the present sample, the input signal is r(n). Applying r(n) to a 1 sample delay (d=1) at 122, a delay output of r(n−1) is produced that represents the value of the previous sample which is fed to the 16-tap predictor. Thus, the 16 taps output the 16 previous samples as follows:

$$r(n-1),r(n-2),r(n-3)\ldots r(n-14),r(n-15),r(n-16).$$

At the end of processing before the new sample arrives, the sample values at the 16 filter taps are shifted one tap to the right. Thus, sample r(n−16) is discarded, sample r(n−15) becomes r(n−16), r(n−14) becomes (r(n−15), . . . , and r(n−1) becomes r(n−2). The first tap is ready to receive the new r(n−1) value produced by the (d=1) delay when the new sample arrives. The adaptive algorithm 130 using the error signal e(n) and the calculated step size generates updated corresponding filter coefficients $C_0$–$C_{15}$. The output signal y(n) of summer 128 is the predicted interference.

Figure 8:
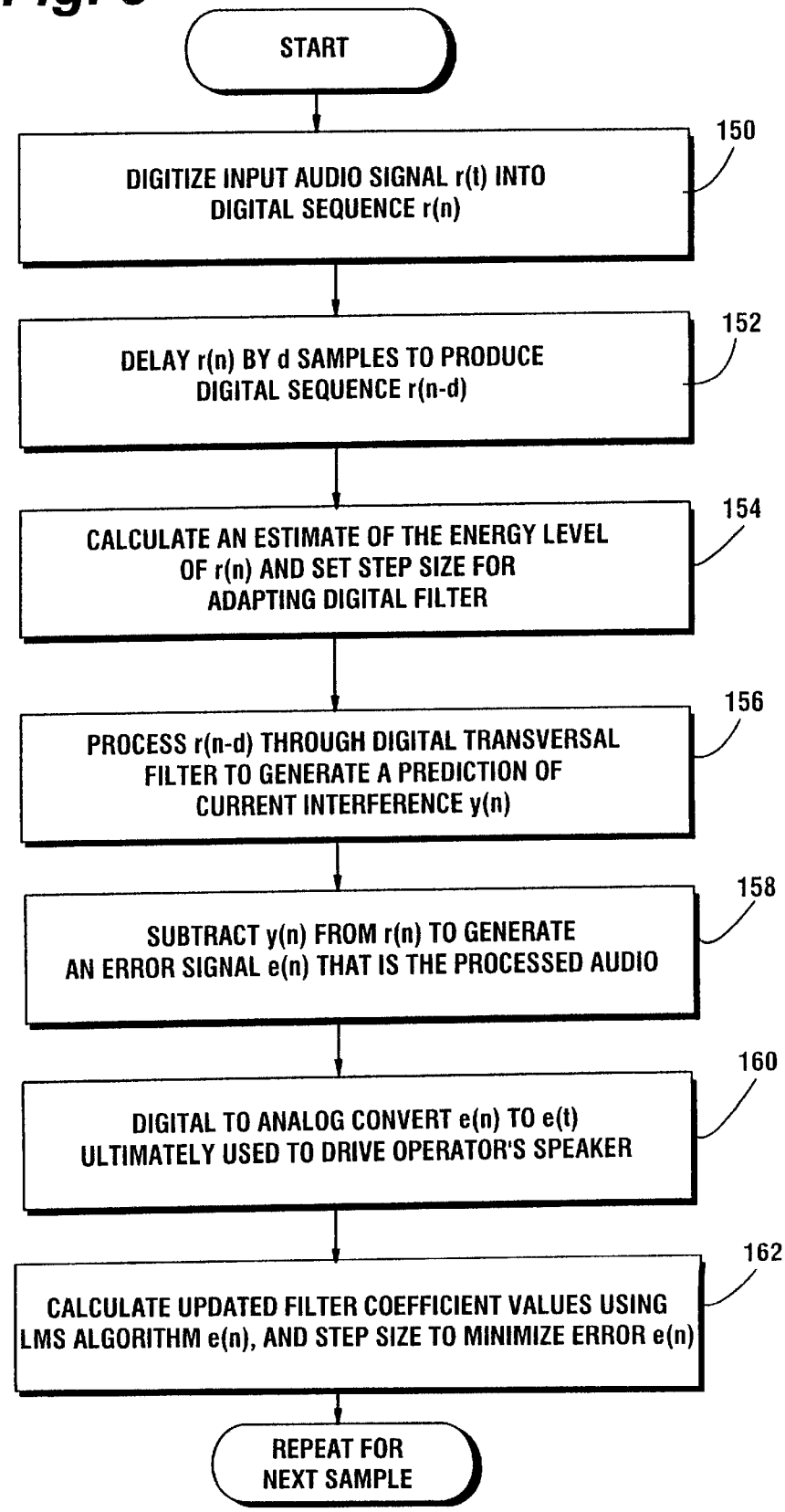
FIG. 8 is flowchart diagram illustrating in further detail methodology for implementing the present invention.

Since the adaptive filter may be implemented using software-controlled data processing circuitry, FIG. 8 illustrates a flowchart of filtering procedures performed electronically in accordance with an example software embodiment of the present invention. The input audio signal r(t) is digitized to generate the digital sample sequence r(n) (block 150). The input audio sample sequence r(n) is delayed by these samples to produce delayed digital sample sequence r(n−d) (block 152). An estimate of the energy level of r(n) is calculated, and a step size for converging/adapting the digital filter is determined (block 154). The delayed signal r(n−d) is processed through a software implementation of the digital transversal filter to predict the current periodic interference y(n) (block 156). The predicted periodic interference y(n) is subtracted from r(n) to generate an output signal e(n) (block 158). The output sample sequence e(n) is reconstructed into an analog signal e(t) that is ultimately used to drive the speaker in a communications device (block 160). An adaptive algorithm, such as the LMS algorithm, calculates updated filter coefficient values using the signal e(n) and the determined step size in an effort to minimize the error e(n) (block 162). This procedure is repeated for each subsequent sequence of digitized audio samples.

The delay 100 is an important parameter in ensuring successful prediction of the interference in the current audio sample sequence. As mentioned above, speech is typically sampled in accordance with the well known Nyquist sampling principle at 8000 Hz or once every 125 microseconds for analog audio signals whose highest frequency component is 3400 Hz. The delay 100 is also determined based on similar sampling and signal reconstruction principles. The delay 100 must be small enough to accurately predict the periodic interference but large enough that the desired information to be preserved is not predicted. In the example embodiment of the present invention, the periodic interference and typically consists of one or two sinusoidal tones. On the other hand, the desired voice signal to be passed and therefore not predicted, is generally aperiodic. In the 16-tap filter example implementation of the invention described above, the inventors of the present invention determined that the optimum delay is one or two sample periods.

Of course, those skilled in the art will appreciate that the parameters which have been specified in this invention including the delay, the number of taps, the step size, etc., while optimized for the specific example application, may change depending on a specific application and specific design goals. For example, the transversal filter parameters set forth in this example embodiment were selected to optimally model/predict and cancel one, two, or three tones present in the voice spectrum. However, if more than this number of tones are to be simultaneously predicted and cancelled, the parameters would likely change, e.g., the filter may use a larger number of taps, etc.

A significant advantage of the present invention is that the adaptive filter does not require prior knowledge of the tone frequencies. that are to be predicted or cancelled. Consequently, the adaptive filter does not require that there be some external measurement of the periodic interference to be predicted or other external signal upon which the prediction is based. To the contrary, the adaptive filter in accordance with the present invention rapidly and accurately predicts the periodic interference using only the received audio sample sequence. In essence, the adaptive filter is self-contained and self-controlled. Moreover, the adaptive filter adapts to and tracks different and changing frequencies. If the frequency of the interfering tone changes, the filter adapts its coefficients to model this change. The adaptive modeling capability of the filter also means that the filter responds appropriately to the signal strength of the interference, i.e., the stronger the interference, the larger the cancellation and vice versa.

The present invention also takes advantage of the fact that the human ear requires a certain amount of signal power to detect sound. Very short but nevertheless high intensity sound typically is not detected by the ear. Similarly, the maximum safe levels of human exposure to higher noise levels is also a function of both signal intensity and duration. For example, some established guidelines suggest that a human should not be exposed to sound at an intensity of 85–90 dB for more than eight hours, 99 dB for more than 30 minutes, 102 dB for 15 minutes, 105 dB for 7.5 minutes, etc. The greater the intensity, the shorter the permissible duration of exposure. The adaptive filter advantageously predicts in only a few iterations the current periodic interference present in the audio signal and therefore effectively reduces or otherwise cancels that interference before it damages the operator's ear, startles the operator, or otherwise adversely impacts the operator's ability to discern voice signals. In fact, in a worst case situation where the adaptive filter might take on the order of 100 iterations to converge to its minimum error, the periodic interference would still be reduced to a minimal value in 12.5 milliseconds. In order for the human ear to detect or otherwise be damaged by high intensity sound, that sound must be present for more than 12.5 milliseconds. Moreover, given the stochastic gradient MS model of convergence, the interference would still be significantly attenuated in a much smaller number of iterations.

Another advantage of the present invention, in addition to its adaptability and speed, is its selectivity. A detected periodic interference after being filtered in accordance with the present invention may be reduced/attenuated by about 70 dB. Again, even in a worst case, typical DTMF and facsimile tones would either be undetected by the human ear, (and therefore are essentially cancelled), or so substantially reduced that they pose no health concern to the human operator's ear. Conversely, the filtering process has little or no effect on the voice audio input which might be attenuated on the order of 1–3 dB. The voice, therefore, passes through the filter without substantial attenuation.

Another advantage of the invention is that if there is no periodic interference, the filter switches itself off. In contrast, a fixed filter always filters whether there is interference or not. If one were, for example, to try to filter known DTMF and fax tones using conventional fixed filters, approximately 12 to 14 fixed filters would be needed. Because these fixed filters would always be operating, the intelligibility of voice information would be severely impacted. In addition to self-activation and deactivation, the present invention also filters changing periodic interference that could be used to intentionally "jam" received voice information. Such a jammer might produce a series of tones having changing frequencies sweeping across the voice spectrum. The inventive filter rapidly tracks and attenuates or cancels the changing jamming interference while recovering the voice information.

While the invention has been described in connection with what is presently considered to be the most practical and preferred embodiment, it is to be understood that the invention is not to be limited to the disclosed example embodiment. On the contrary, the invention is intended to cover various modifications and equivalent arrangements included within the spirit and scope of the appended claims.

What is claimed is:

1. A method for processing electronically generated audible signals listened to by an operator, comprising the steps of:

receiving the audible signals, the audible signals including both voice and a substantially periodic signal that interferes with the voice;

modeling the periodic interference using an adaptive filter with plural taps;

using the adaptive filter, reducing the periodic interference in the received audible signals based on the modeled periodic interference so that the periodic interference does not adversely affect the hearing of the operator listening to the received audible signals, or the operator's ability to discern the voice received with the periodic interference after the periodic interference is reduced;

determining a signal energy associated with a portion of the received mobile signals;

determining an adjustment factor based on the determined signal energy including calculating a step size based on the determined signal energy and on a number of the plural adaptive filter taps; and adapting the periodic interference model using the determined adjustment factor.

2. The method in claim 1, wherein the interference is substantially attenuated without substantially attenuating voice received with the interference.

3. The method in claim 1, wherein the interference is periodic interference is a jamming signal.

4. The method in claim 1, wherein the periodic interference includes a tone having a first frequency.

5. The method in claim 4, further comprising:

tracking a frequency change of the tone, and substantially attenuating the tracked tone.

6. The method in claim 3, wherein the periodic interference includes plural tones having different frequencies and the plural tones are substantially attenuated.

7. The method in claim 6, further comprising:

tracking a frequency change of one or more of the tones, and substantially attenuating the tracked one or more tones.

8. The method in claim 1, wherein the audible range is 300 to 3400 Hertz.

9. The method in claim 1, the reducing step further comprising:

delaying the received signal to generate a delayed signal that precedes a currently received signal, wherein the modeled periodic interference in the currently received signal is based on the delayed signal.

10. The method in claim 9, wherein the reducing step includes substantially attenuating or removing the modeled periodic interference.

11. The method in claim 9, wherein the delay is small enough to model the periodic interference and large enough so that the voice is not also modeled.

12. The method in claim 9, wherein the periodic interference is modeled from the received audio signal without using a reference signal corresponding to the interference generated from a source other than the received audio signals.

13. In call handling system having a telecommunications switch, and a plurality of operator computer stations connected to the telecommunications switch, each computer station including a communication device having a microphone and a speaker permitting the operator at the computer station to participate in voice communications with one or more parties via calls established through the telecommunications switch, a method of processing an audio signal including voice and periodic interference in an audible frequency band delivered to the operator by way of the speaker where a decibel level of the periodic interference output by the speaker may exceed a threshold that is undesirable to the operator listening to the communications device, comprising the steps of:

sampling the audio signal at a predetermined sampling rate to generate a signal sequence;

determining a signal energy of the signal sequence;

based on a previous sequence of samples, predicting a current value of the periodic interference by delaying the signal sequence by a predetermined delay and filtering the delayed signal sequence to generate a filter output; and removing the predicted current value of the periodic interference to ensure that the decibel level of the periodic interference present in the current signal is less than the threshold by subtracting the filtered output from the signal sequence to generate a difference signal;

wherein the method further comprises:

adapting filter parameters used in the filtering step based on the difference signal, and determining a step size used in adapting the filter parameters based on the signal energy.

14. The method in claim 13, wherein the step size is determined in accordance with the following:

step size=0.0078/(a number of filter taps*the signal energy).

15. The method in claim 13, wherein the predetermined delay is one sample period.

16. The method in claim 13, wherein the delay is small enough to predict periodic interference and large enough so that the voice is not predicted.

17. The method in claim 13, wherein the interference is predicted from the audio signal without using a reference corresponding to the interference generated from a source other than the audio signal.

18. The method in claim 13, further comprising:

tracking a frequency change of the periodic interference, and removing a predicted contribution of the tracked periodic interference from the current sample.

19. A call handling system comprising:

a telecommunications switch, and a plurality of operator computer stations connected to the telecommunications switch, each computer station including a communication device having a microphone and a speaker permitting the operator at the computer station to participate in voice communications with one or more parties via calls established through the telecommunications switch, some of the calls including one or more audible tones, and an audio signal processor, wherein the audio processor includes:

an analog to digital converter for converting received audio signals from the telecommunications switch into digitized audio samples;

an adaptive filter connected to the analog to digital converter substantially reducing an amplitude of a tone or other periodic interference occurring in a current audio sample while substantially preserving an amplitude of the voice information in the current audio sample;

a filter adaptor determining (1) a signal energy associated with the current audio sample and (2) an adjustment factor based on that determined signal energy and adapting the adaptive filter using the determined adjustment factor;

a digital to analog converter converting an output signal from the adaptive filter into an analog audio signal; and an amplifier amplifying the analog audio signal and forwarding the amplified signal to drive the speaker.

20. The call handling system in claim 19, wherein each operator computer station includes a personal computer and the audio processor is included in the personal computer.

21. The call handling system in claim 19, wherein the adjustment factor includes a step size calculated using the determined signal energy and a number of taps employed in the adaptive filter.

22. The call handling system in claim 19, wherein the audio processor includes a predictor for predicting the tone or other periodic interference occurring in the current audio signal based on previously processed audio samples, and wherein the audio processor removes the predicted tone or other periodic interference from the current audio signal.

23. The call handling system in claim 22, wherein the audio processor predicts the tone or other periodic interference and removes the predicted tone or other periodic interference from the current audio is signal before the operator can detect an initial amplitude of the tone.

24. The call handling system in claim 19, wherein the audio processor adaptively tunes the filter based on a difference between the predicted tone or other periodic interference and the current audio signal.

25. The call handling system in claim 19, wherein the audio processor tracks a frequency change in the tone or other periodic interference.

26. The call handling system in claim 19, wherein the audio processor substantially reduces an amplitude of plural tones occurring in a current audio signal while substantially preserving an amplitude of the voice information in the current audio signal.

27. The call handling system in claim 19, wherein the tone or other periodic interference is predicted from the audio samples without using a reference signal corresponding to the interference generated from a source other than the audio samples.

28. A digital filter for use in processing audio signals in a call handling system, comprising:

a delay that receives and delays a digitized sequence of samples corresponding to an audio signal, the audio signal having both voice and interference;

series-connected filter taps connected to the delayed signal sequence;

plural multipliers, each multiplier multiplying a signal from a corresponding one of the filter taps with a corresponding filter coefficient;

a summer summing outputs from the multipliers to generate a signal predicting periodic interference in a current sample;

a combiner for subtracting the predicted periodic interference from the current sample to obtain a difference signal;

an adaptive controller recursively modifying the filter coefficients in response to the difference signal and a step size; and a signal energy detector determining the energy of the sequence of samples, wherein the step size is determined based on the determined signal energy and a number of the plural filter taps.

29. The digital filter in claim 28, wherein the number of filter taps is 16.

30. The digital filter in claim 28, wherein the delay corresponds to one sample time period.

31. The digital filter in claim 28, wherein subtracting the predicted interference from the current sample does not remove or otherwise substantially affect the voice in the current sample.

32. The digital filter in claim 28, wherein the periodic interference is a jamming signal.

33. The digital filter in claim 32, wherein the periodic interference is one or more DTMF or facsimile tones.

34. The digital filter in claim 32, wherein the predetermined delay is determined so that the delay is small enough for the filter to predict the periodic interference and large enough so that the filter does not predict the voice.

35. The digital filter in claim 28, wherein the interference is predicted from the sample sequence without using a reference signal corresponding to the interference generated externally to the digital filter.

* * * * *